US007919701B2

(12) United States Patent
Yang

(10) Patent No.: US 7,919,701 B2
(45) Date of Patent: Apr. 5, 2011

(54) CONNECTION DEVICE FOR A DRUM SET

(75) Inventor: Shin-Ming Yang, Lu Chou (TW)

(73) Assignee: K.H.S. Musical Instrument Co., Ltd., Lu Chou, Taipei Hsien (TW)

( * ) Notice: Subject to any disclaimer, the term of this patent is extended or adjusted under 35 U.S.C. 154(b) by 0 days.

(21) Appl. No.: 12/685,460

(22) Filed: Jan. 11, 2010

(65) Prior Publication Data

US 2010/0180749 A1 Jul. 22, 2010

(30) Foreign Application Priority Data

Jan. 20, 2009 (TW) ..... 98201056 U

(51) Int. Cl.
*G10D 13/08* (2006.01)

(52) U.S. Cl. ..... 84/411 R

(58) Field of Classification Search ..... 84/421, 84/420, 411 R, 422.1, 422.3, 422.2
See application file for complete search history.

(56) References Cited

U.S. PATENT DOCUMENTS 4,185,808 A * 1/1980 Donohoe et al. ..... 248/295.11
* cited by examiner

*Primary Examiner* — Kimberly R Lockett
(74) *Attorney, Agent, or Firm* — Apex Juris, PLLC; Tracy M Heims

(57) ABSTRACT

A connection device for a drum set has a connecting bridge, multiple resilient pads and a clamping device. The connecting bridge has a base board and two connecting arms. The connecting arms protrude respectively from two sides of the base board and each has a connecting end for connection to an adjusting rod attached to a drum shell of a drum. The resilient pads are mounted respectively on the connecting ends of the connecting arms and are mounted around the adjusting rods. The clamping device is securely mounted on the base board and has a clamping base, a clamping leaf, a locking rod and a locking element. Therefore, the connection device allows the drum to vibrate for improved timbre.

10 Claims, 5 Drawing Sheets

CONNECTION DEVICE FOR A DRUM SET

BACKGROUND OF THE INVENTION

1. Field of the Invention

The present invention relates to a connection device, and more particularly to a connection device for a drum set that can vibrate for improved timbre.

2. Description of Related Art

A connection assembly is used to connect multiple drums to form a drum set and has multiple connection devices connected to a stand or each other and attached respectively to the drums. However, each connection device of a conventional connection assembly is securely and directly attached or clamped to a drum shell of a corresponding drum, but this will influence resonance and timbre of the drum. Additionally, the conventional connection device cannot vibrate, so vibration of the drum is limited due to being securely and directly clamped by the conventional connection device.

To overcome the shortcomings, the present invention tends to provide a connection device for a drum set to mitigate or obviate the aforementioned problems.

SUMMARY OF THE INVENTION

The main objective of the invention is to provide a connection device for a drum set that can vibrate for improved timbre. The connection device has a connecting bridge, multiple resilient pads and a clamping device.

The connecting bridge has a base board and two connecting arms. The connecting arms protrude respectively from two sides of the base board and each has a connecting end for connection to an adjusting rod attached to a drum shell of a drum.

The resilient pads are mounted respectively on the connecting ends of the connecting arms and are mounted around the adjusting rods.

The clamping device is securely mounted on the base board and has a clamping base, a clamping leaf, a locking rod and a locking element. The clamping base is securely attached to the base board and has a clamping side, a clamping groove and a locking hole. The clamping side is away from the base board. The clamping groove is defined longitudinally in the clamping side. The locking hole is defined through the clamping base. The clamping leaf is pivotally connected to the clamping base and has a clamping side, a clamping groove and a locking hole. The clamping side faces the clamping side of the clamping base. The clamping groove is defined longitudinally in the clamping side of the clamping leaf and aligns with the clamping groove in the clamping base. The locking hole is defined through the clamping leaf and aligns with the locking hole in the clamping base. The locking rod is mounted though the locking holes in the clamping base and clamping leaf. The locking element adjustable engages the locking rod. Therefore, the connection device allows the drum to vibrate for improved timbre.

Other objects, advantages and novel features of the invention will become more apparent from the following detailed description when taken in conjunction with the accompanying drawings.

DETAILED DESCRIPTION OF PREFERRED EMBODIMENT

Figure 1:
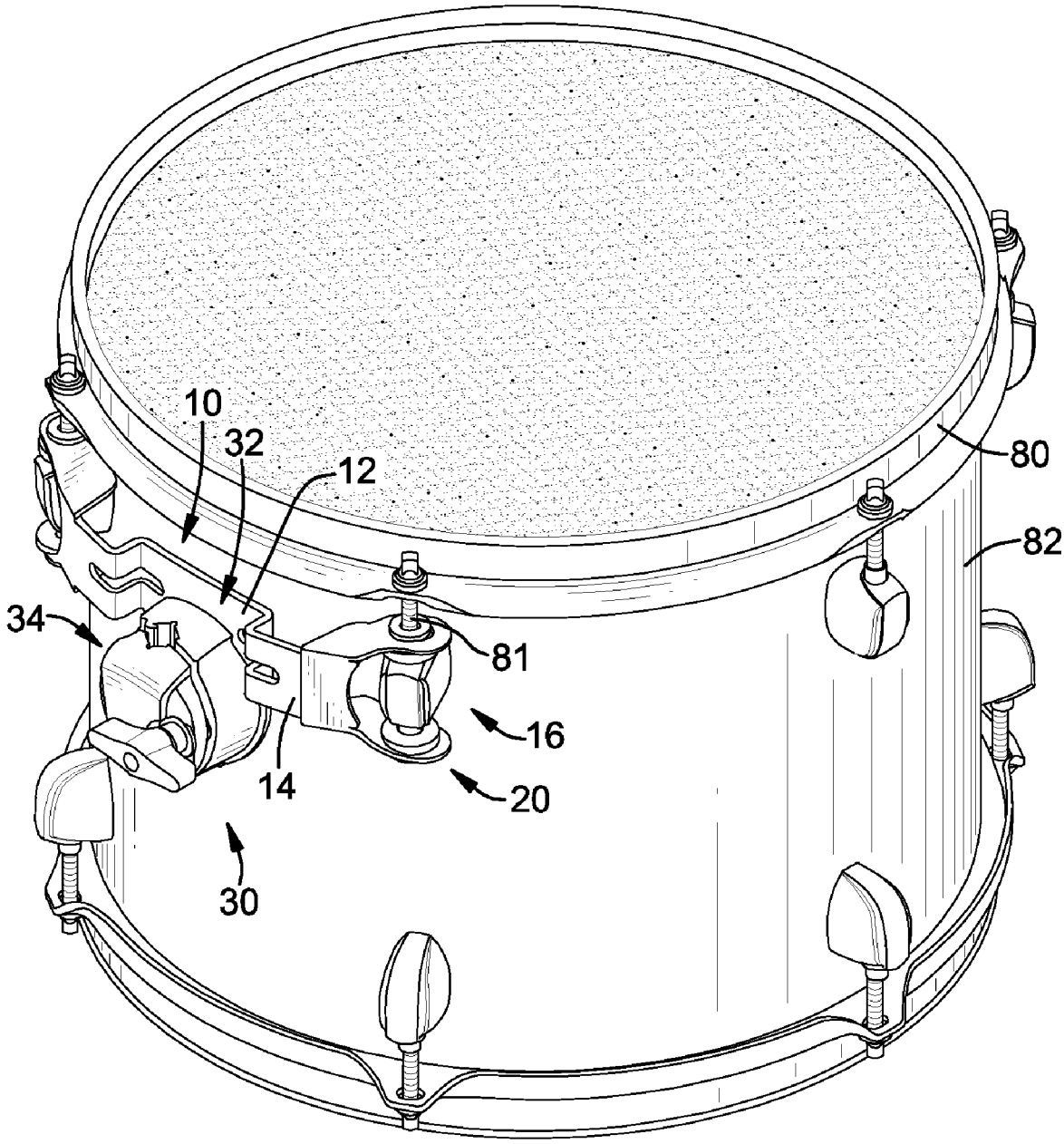
FIG. 1 is a perspective view of a drum with a connection device in accordance with the present invention.
Figure 2:
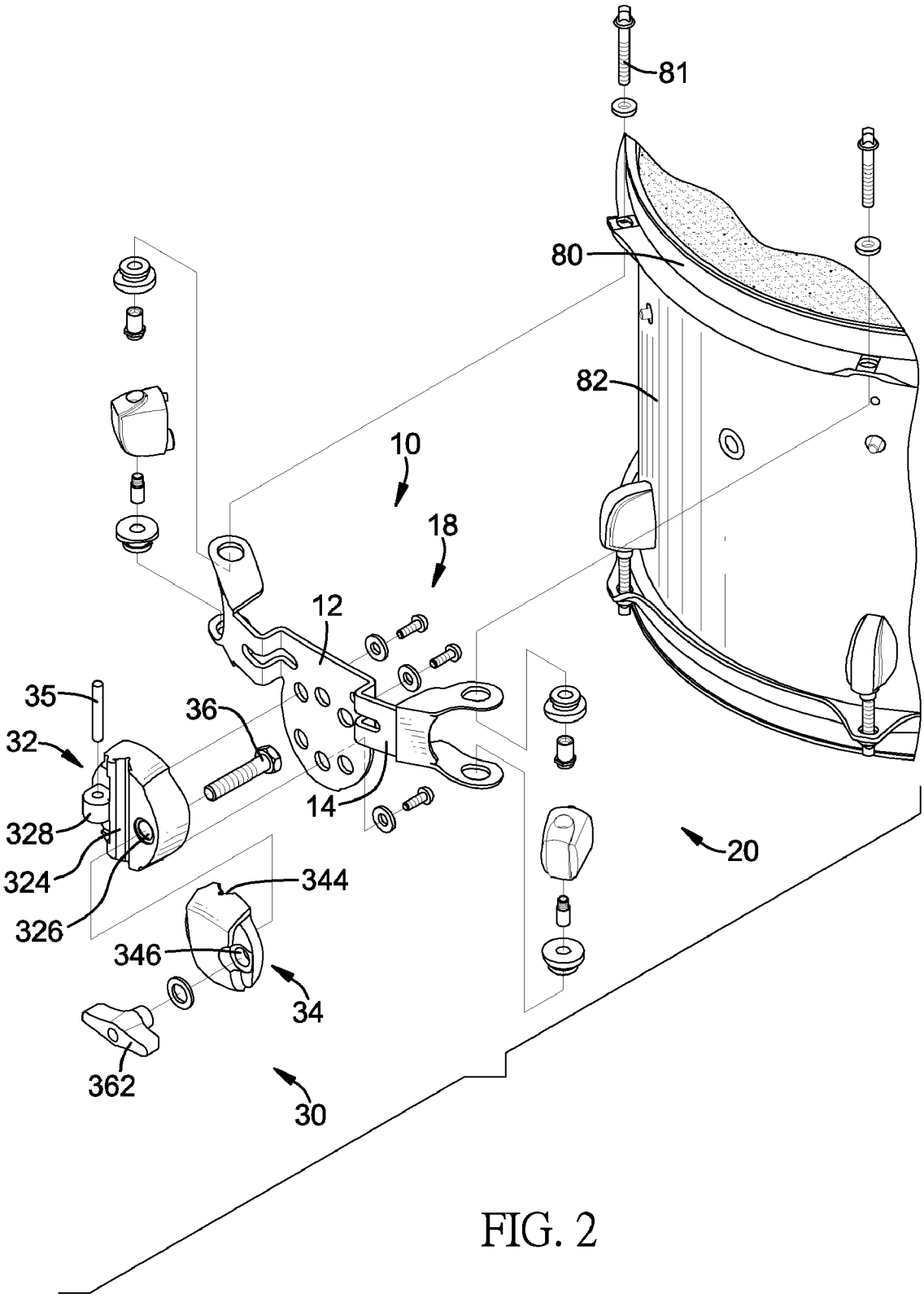
FIG. 2 is an exploded perspective view of the connection device in FIG. 1.
Figure 3:
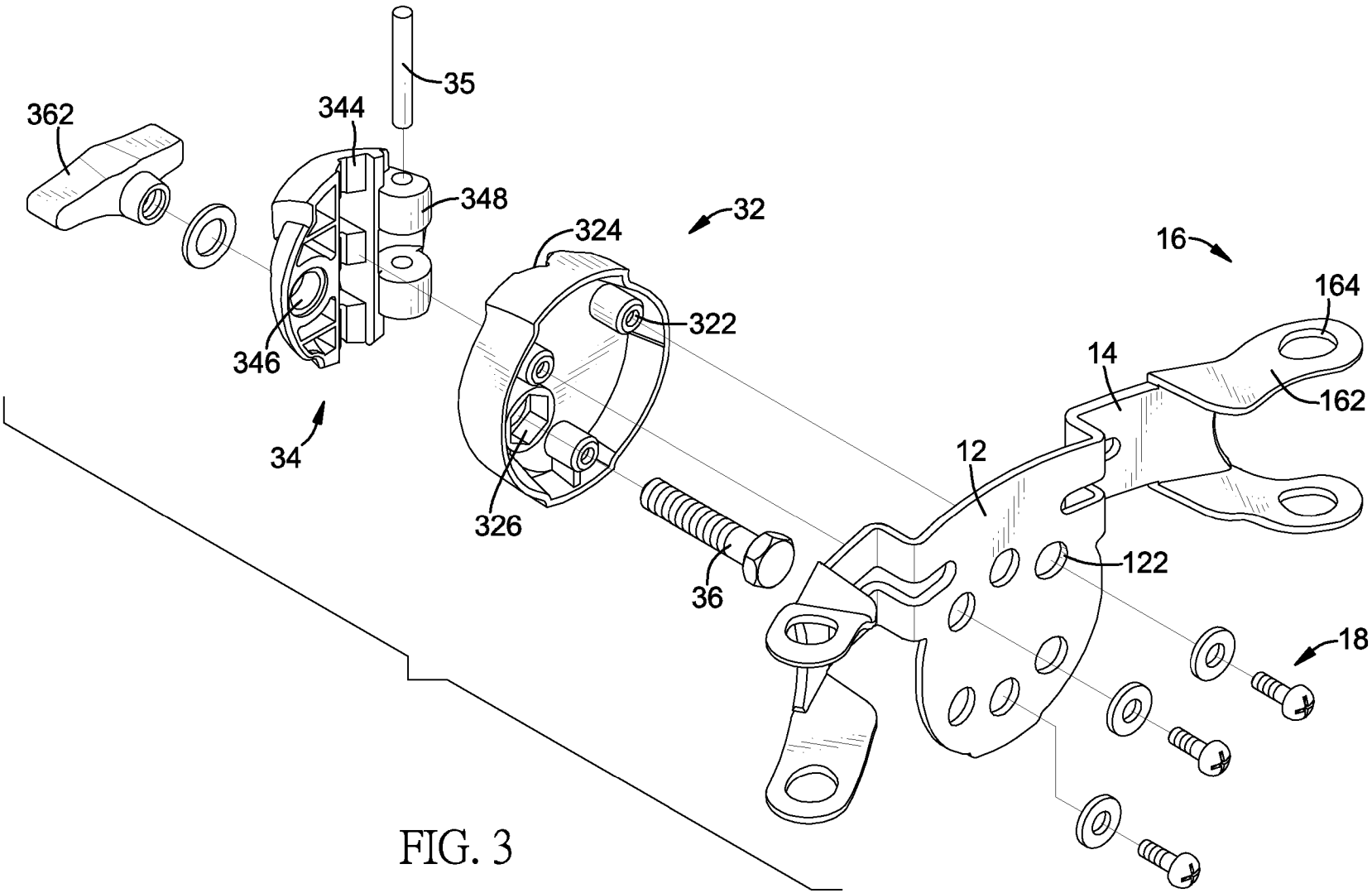
FIG. 3 is an enlarged exploded perspective view of the connection device in FIG. 2.

With reference to FIGS. 1 to 3, a connection device for a drum set in accordance with the present invention comprises a connecting bridge (10), multiple resilient pads (20) and a clamping device (30).

The connecting bridge (10) comprises a base board (12) and two connecting arms (14). The base board (10) has two sides and multiple mounting holes (122) defined through the base board (12). The connecting arms (14) protrude respectively from the sides of the base board (12), can vibrate independent of the base board (12) and each connecting arm (14) has a connecting end (16) for connection to an adjusting rod (81) attached to a drum shell (82) of a drum (80). Wherein, the adjusting rods (81) are mounted on the drum shell (82) of the drum (80) for adjusting tightness of the drum shell (82) for further adjusting the timbre of the drum (80). Because the adjusting rods (81) are inherent elements of a drum (80) and may be conventional, detail description of the adjusting rods (81) is omitted. The connecting arms (14) may be bent to adjust relative levels of the connecting arms (14) and the base board (12). In a preferred embodiment, the connecting end (16) of each connecting arm (14) is a clevis (162) having two aligned connecting holes (164) mounted around a corresponding adjusting rod (81).

The resilient pads (20) are mounted respectively on the connecting ends (16) of the connecting arms (14), may be mounted in aligned mounting holes (164) of respective clevises (162) and are mounted around the adjusting rods (81). The resilient pads (20) may be plastic or rubber.

The clamping device (30) is securely mounted on the base board (12) and comprises a clamping base (32), a clamping leaf (34), a locking rod (36) and a locking element (362). The clamping base (32) is securely attached to the base board (12) and has a mounting side, a clamping side, multiple threaded holes (322), a clamping groove (324), a locking hole (326) and at least one barrel (328). The mounting side faces and is attached to the base board (12). The clamping side is away from the base board (12). The threaded holes (322) are defined in the mounting side and align respectively with the mounting holes (122) in the base board (12). Multiple bolts (18) are mounted respectively through the mounting holes (122) in the base board (12) and are screwed respectively into the threaded holes (322) in the clamping base (32) to secure the clamping base (32) to the base board (12). The clamping groove (324) is defined longitudinally in the clamping side. The locking hole (326) is defined through the clamping base (32). The at least one barrel (328) is formed on and protrudes from the clamping side of the clamping base (32).

Figure 4:
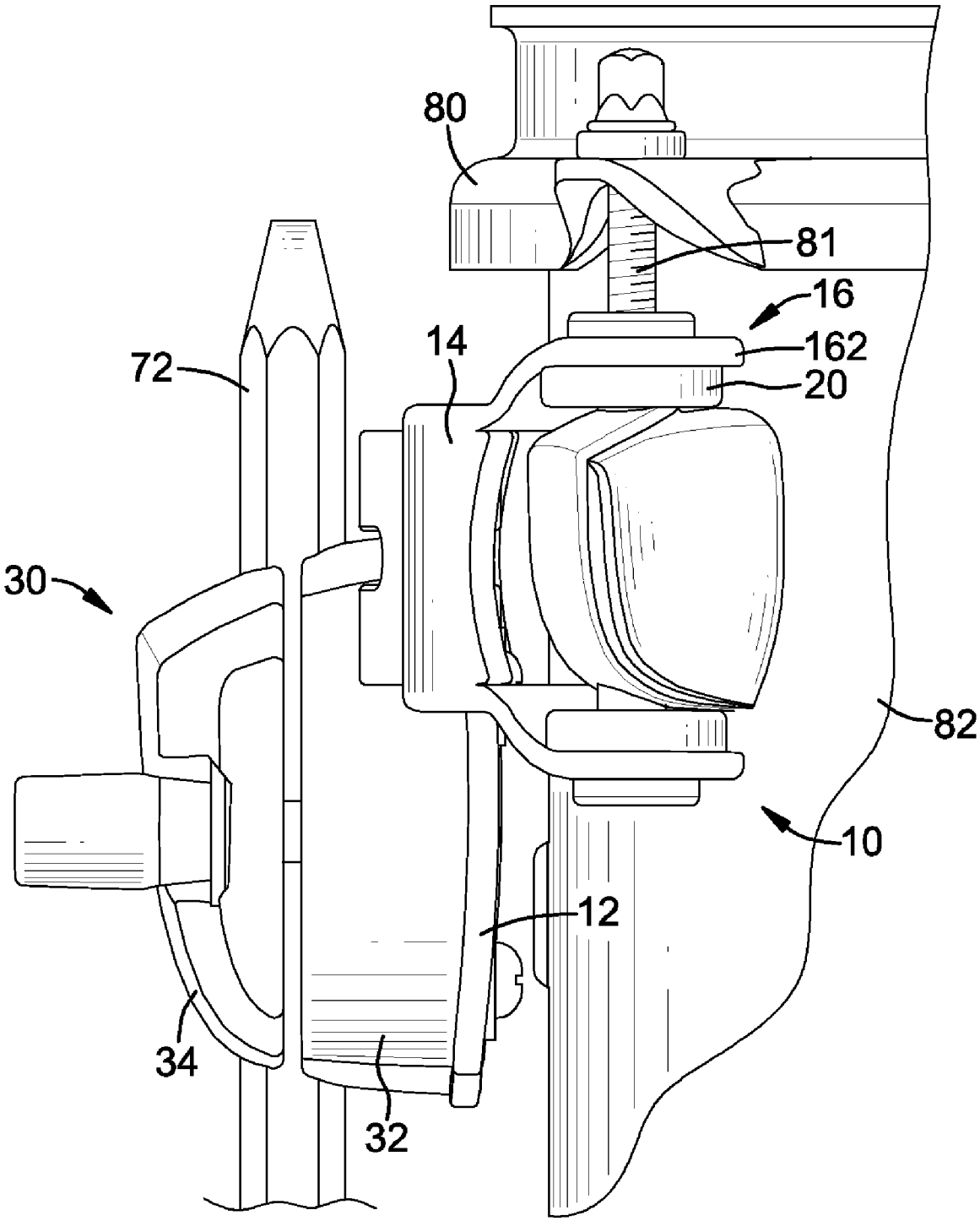
FIG. 4 is an enlarged operational side view of the connection device in FIG. 1 combined with a connection rod.

With further reference to FIG. 4, the clamping leaf (34) is pivotally connected to the clamping base (32) and has a clamping side, a clamping groove (344), at least one barrel (348) and a locking hole (346). The clamping side of the clamping leaf (34) faces the clamping side of the clamping base (32). The clamping groove (344) of the clamping leaf (34) is defined longitudinally in the clamping side of the clamping leaf (34) and aligns with the clamping groove (324) in the clamping base (32) to define a clamping channel between the clamping base (32) and the clamping leaf (34) for holding a connection rod (72). The at least one barrel (348) is formed on and protrudes from the clamping side of the clamping leaf (34) and aligns with the at least one barrel (328) on the clamping base (32). A pivot pin (35) is mounted through the barrels (328,348) on the clamping base (32) and clamping leaf (34) to pivotally connect the clamping leaf (34) to the clamping base (32). The locking hole (346) is defined through the clamping leaf (34) and aligns with the locking hole (326) in the clamping base (32). In the preferred embodiment, the locking hole (346) in the clamping leaf (34) is defined near a side edge of the clamping leaf (34) away from the pivot pin (35).

The locking rod (36) is mounted though the locking holes (326,346) in the clamping base (32) and clamping leaf (34), and the locking element (362) adjustably engages the locking rod (36). In the preferred embodiment, the locking element (362) engages the locking rod (36) by threads and may be formed as a knob. Engagement between the locking rod (36) and the locking element (362), the clamping leaf (34) securely closes the clamping base (32).

Figure 5:
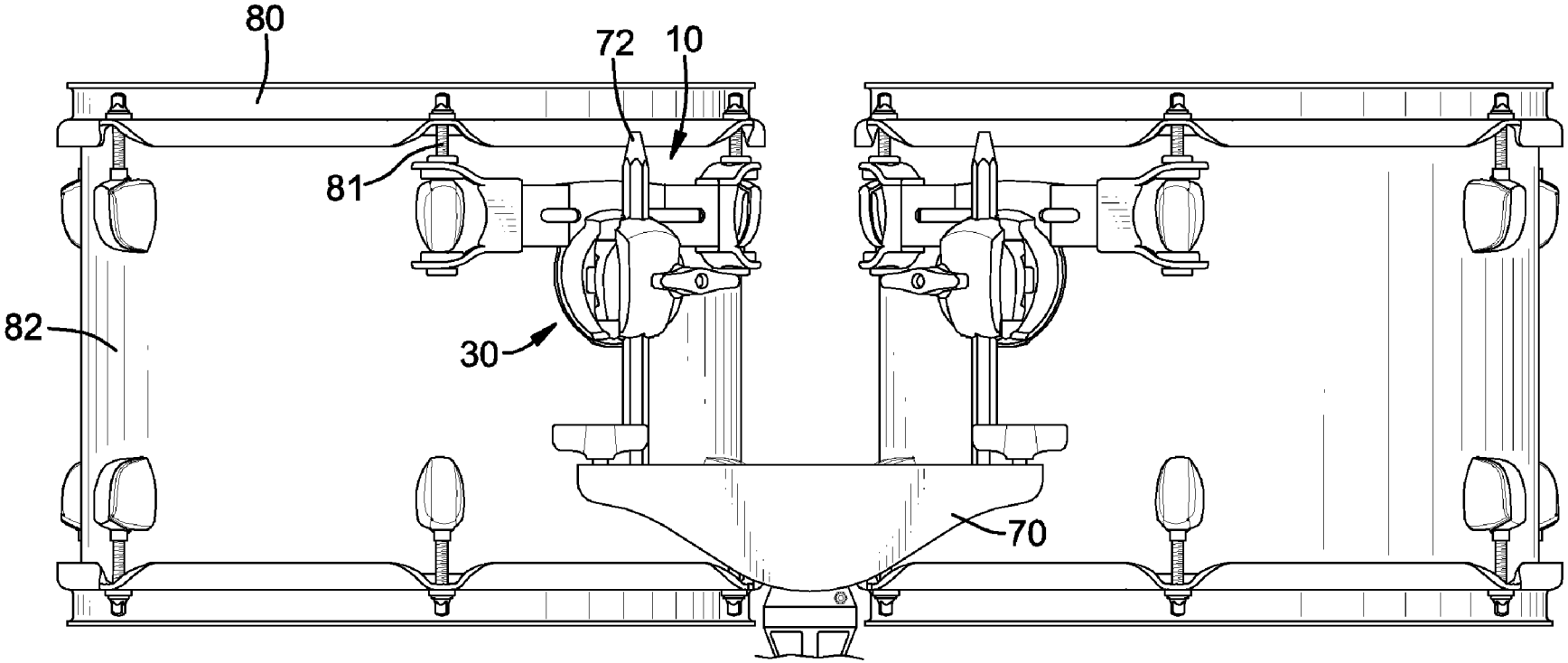
FIG. 5 is a side view of a drum set including two connection devices in FIG. 1 on a connection assembly connecting two drums.

With further reference to FIG. 5, multiple drums (80) can be connected with each other to form a drum set with multiple connection devices clamping connection rods (72) that are securely attached to a stand (70). Because the connecting arms (14) are connected securely to the adjusting rods (81) on a corresponding drum (80) and not directly to the drum shell (82), the connection device does not influence resonance and timbre of the drum (80). In addition, a gap is defined between the base board (12) and the drum shell (82) and the connection arms (14) can vibration independent of the base board (12), the connection arms (14) will vibrate with the vibration of the drum (80) after the drum (80) is hit. Accordingly, the timber of the drum (80) can be efficiently improved.

Furthermore, because the connecting arms (14) may be at different levels relative to the base board (12), the distance between adjacent drums (80) connected by two connection devices in accordance with the present invention can be shortened. Accordingly, space required for packing, transporting or storing a drum set can be efficiently reduced.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A connection device for a drum set comprising:

a connecting bridge having a base board having two sides; and two connecting arms protruding respectively from the sides of the base board and each having a connecting end for connection to an adjusting rod attached to a drum shell of a drum;

multiple resilient pads mounted respectively on the connecting ends of the connecting arms and adapted for mounting around the adjusting rods; and a clamping device securely mounted on the base board and comprising a clamping base securely attached to the base board and having a clamping side being away from the base board;

a clamping groove defined longitudinally in the clamping side; and a locking hole defined through the clamping base;

a clamping leaf pivotally connected to the clamping base and having a clamping side facing the clamping side of the clamping base;

a clamping groove defined longitudinally in the clamping side of the clamping leaf and aligning with the clamping groove in the clamping base; and a locking hole defined through the clamping leaf and aligning with the locking hole in the clamping base;

a locking rod mounted though the locking holes in the clamping base and clamping leaf; and a locking element adjustably engaging the locking rod.

2. The connection device as claimed in claim 1, wherein each connecting arm is bent to dispose the connecting arm at a different relative level to the base board.

3. The connection device as claimed in claim 2, wherein the connecting end of each connecting arm is a clevis having two aligned connecting holes adapted to mount a corresponding adjusting rod; and the resilient pads are mounted in aligned connecting holes of respective clevises.

4. The connection device as claimed in claim 3, wherein the base board has multiple mounting holes defined through the base board;

the clamping base further has a mounting side; and multiple threaded holes defined in the mounting side and aligning respectively with the mounting holes in the base board; and multiple bolts mounted respectively through the mounting holes in the base board and screwed respectively into the threaded holes in the clamping base to secure the clamping base to the base board.

5. The connection device as claimed in claim 4, wherein the locking element engages the locking rod by threads and is formed as a knob.

6. The connection device as claimed in claim 5, wherein the clamping base has at least one barrel formed on and protruding from the clamping side of the clamping base;

the clamping leaf has at least one barrel formed on and protruding from the clamping side of the clamping leaf and aligning with the at least one barrel on the clamping base;

a pivot pin is mounted through the barrels on the clamping base and clamping leaf to pivotally connect the clamping leaf to the clamping base; and the locking hole in the clamping leaf is defined near a side edge of the clamping leaf away from the pivot pin.

7. The connection device as claimed in claim 1, wherein the connecting end of each connecting arm is a clevis having two aligned connecting hole adapted to mount a corresponding adjusting rod; and the resilient pads are mounted in aligned connecting holes of respective clevises.

8. The connection device as claimed in claim 1, wherein the base board has multiple mounting holes defined through the base board;

the clamping base further has a mounting side; and multiple threaded holes defined in the mounting side and aligning respectively with the mounting holes in the base board; and multiple bolts mounted respectively through the mounting holes in the base board and screwed respectively into the threaded holes in the clamping base to secure the clamping base to the base board.

9. The connection device as claimed in claim 1, wherein the locking element engages the locking rod by threads and is formed as a knob.

10. The connection device as claimed in claim 1, wherein the clamping base has at least one barrel formed on and protruding from the clamping side of the clamping base;

the clamping leaf has at least one barrel formed on and protruding from the clamping side of the clamping leaf and aligning with the at least one barrel on the clamping base;

a pivot pin is mounted through the barrels on the clamping base and clamping leaf to pivotally connect the clamping leaf to the clamping base; and the locking hole in the clamping leaf is defined near a side edge of the clamping leaf away from the pivot pin.

* * * * *